US011535430B1

(12) United States Patent
Laible

(10) Patent No.: US 11,535,430 B1
(45) Date of Patent: Dec. 27, 2022

(54) SINGLE DRAW CONTAINER INSERT HAVING TWO METERED FLOW OUTLETS

(71) Applicant: Rodney Laible, Omaha, NE (US)

(72) Inventor: Rodney Laible, Omaha, NE (US)

( * ) Notice: Subject to any disclaimer, the term of this patent is extended or adjusted under 35 U.S.C. 154(b) by 0 days.

(21) Appl. No.: 17/534,798

(22) Filed: Nov. 24, 2021

(51) Int. Cl.
*B65D 47/04* (2006.01)
*B65D 47/12* (2006.01)
*B05B 15/30* (2018.01)
*B05B 1/14* (2006.01)

(52) U.S. Cl.
CPC ..... *B65D 47/12* (2013.01); *B05B 1/14* (2013.01); *B05B 15/30* (2018.02)

(58) Field of Classification Search
CPC .. B65D 47/261; B65D 47/263; B65D 47/265; B65D 47/266; B65D 47/12; B05B 15/30; B05B 1/14
USPC ..... 222/464.1, 482, 545
See application file for complete search history.

(56) References Cited

U.S. PATENT DOCUMENTS 3,005,578 A * 10/1961 Mainicri ..... G01F 11/263 222/548
4,832,235 A * 5/1989 Palmer ..... G01F 11/24 222/548
5,730,322 A * 3/1998 Iba ..... B65D 47/265 222/212
6,543,654 B1 * 4/2003 Uhl ..... B65D 47/06 215/253
7,513,399 B2 * 4/2009 Mengeu ..... B65D 47/265 222/567
7,766,197 B2 * 8/2010 Getsy ..... B65D 47/265 222/480
8,844,776 B2 * 9/2014 Haas ..... B67D 7/0294 222/481.5
8,985,369 B2 * 3/2015 DeMarco ..... B65D 47/265 220/253
9,505,603 B2 * 11/2016 Hennen ..... B67D 7/344
9,963,279 B2 * 5/2018 Huber ..... B67D 3/0051
10,640,359 B1 * 5/2020 Laible ..... B65D 47/32
10,888,826 B2 * 1/2021 Waggoner ..... B65D 47/06
11,220,379 B2 * 1/2022 Heinbuch ..... B67D 7/0294
2007/0199959 A1 * 8/2007 Getsy ..... B65D 47/265 222/548
2009/0026222 A1 * 1/2009 Seelhofer ..... B65D 81/3244 222/129
2011/0309114 A1 * 12/2011 Chen ..... B67D 7/0288 222/464.1
2012/0017766 A1 * 1/2012 Anson ..... B65D 47/243 99/290
2012/0234872 A1 * 9/2012 Good ..... B05B 11/3045 222/464.1

(Continued)

*Primary Examiner* — Charles P. Cheyney
(74) *Attorney, Agent, or Firm* — Luke C. Holst; McGrath North Mullin & Kratz, PC LLO

(57) ABSTRACT

A single draw container insert having two metered flow outlets is described. The valve of the single draw container includes a lower support member and a valve member rotatably positioned therein. The valve member has a central metering opening formed therein and a metering opening formed therein at the periphery thereof. The flow rates may be changed by changing the diameter of the central opening in the valve member or the opening in the periphery of the valve member. The opening at the periphery of the valve member may be controlled by the apparatus associated therewith.

20 Claims, 3 Drawing Sheets

(56) References Cited

U.S. PATENT DOCUMENTS

| | | | | |
|---|---|---|---|---|
| 2013/0008919 | A1* | 1/2013 | Honan | G01F 11/26 222/23 |
| 2015/0001261 | A1* | 1/2015 | Johnson | B67D 3/045 53/469 |

* cited by examiner

SINGLE DRAW CONTAINER INSERT HAVING TWO METERED FLOW OUTLETS

BACKGROUND OF THE INVENTION

Field of the Invention

This invention relates to a container insert for chemical containers and more particularly relates to a single draw container insert having two metered flow outlets.

Description of the Related Art

Applicant has received many patents relating to container inserts, one of which is U.S. Pat. No. 10,618,705 B1. In many of those patents, the chemical is drawn upwardly from the liquid container by two draw tubes so that two chemicals may be dispersed with the tubes. Although Applicant's earlier patents have experienced commercial success, the two different draw tubes and related materials are somewhat expensive to manufacture.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

The single draw container insert of this invention provides two metered flow outlets. The container insert of this invention is designed to be used with a liquid container and includes a lower ring-shaped member having a horizontally disposed ring-shaped and disc-shaped bottom wall having an upper side and a lower side. The bottom wall has a central opening formed therein which has a hollow tube extending downwardly therefrom. The lower end of the hollow tube has oppositely disposed and radially spaced-apart openings formed therein.

A ring-shaped valve member is rotatably mounted in the lower member. The valve member has a central opening formed therein and an opening formed therein inwardly of the wall member. The sizes of the openings in the valve member control the volume flow rate. The outer opening may be controlled by the apparatus with which the insert is utilized.

It is therefore a principal object of the invention to provide an improved single draw container insert having two metered flow outlets.

A further object of the invention is to provide a device of the type described which enables different metered flows to be discharged from the apparatus.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
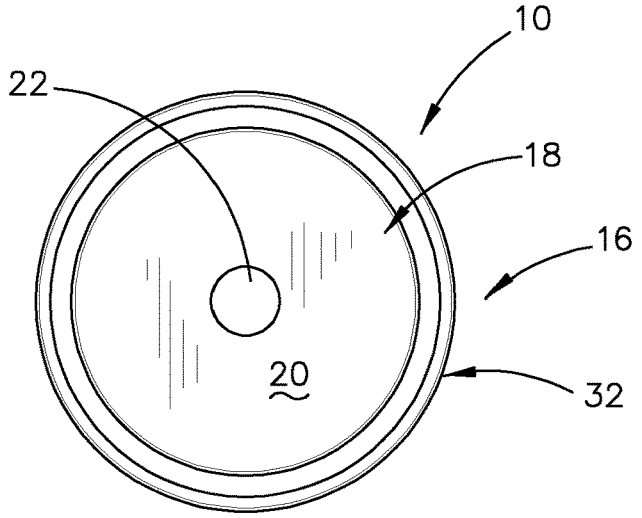
FIG. 1 is a top view of the valve for the insert of FIG. 7 (and other single draw devices)
Figure 2:
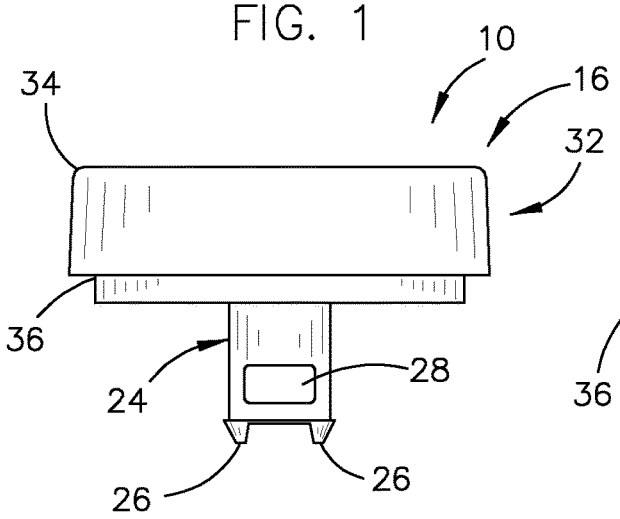
FIG. 2 is a side view of the valve of FIG. 1.
Figure 3:
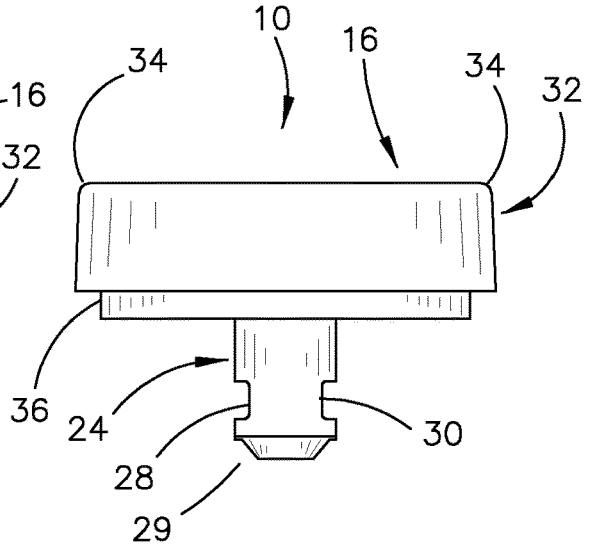
FIG. 3 is another side view of the valve of FIG. 1.
Figure 4:
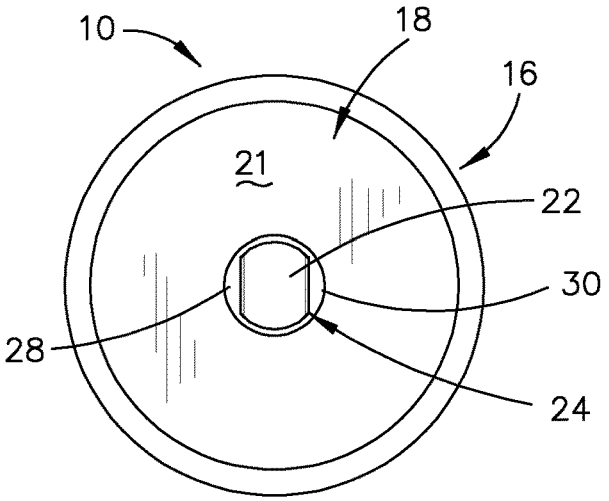
FIG. 4 is a bottom view of the valve of FIG. 1.
Figure 5:
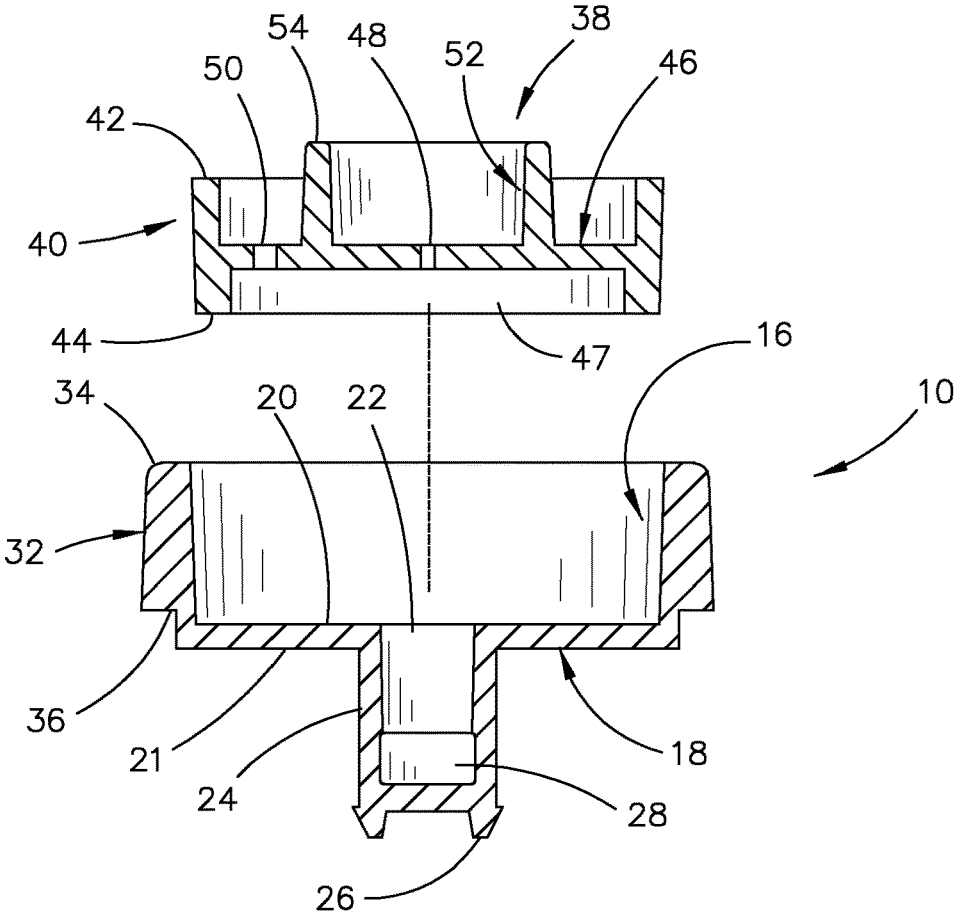
FIG. 5 is a sectional view of the valve member of the valve of FIG. 1 and the lower portion of this invention.
Figure 6:
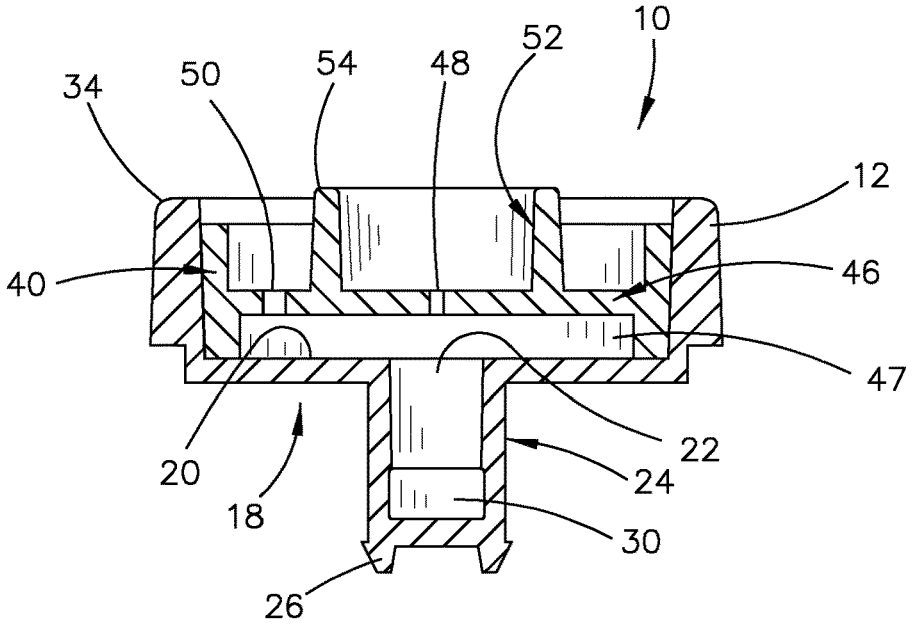
FIG. 6 is a sectional view of the valve of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The single draw container insert having two metered flow outlets of this invention is referred to by the reference numeral 10. The container insert is designed to be used with a liquid container having an outlet opening. Insert 10 includes a lower ring-shaped member 16 having a horizontally disposed ring-shaped and disc-shaped bottom wall 18 having an upper side 20 and a lower side 21. Bottom wall 18 has a central opening 22 formed therein. A hollow tube 24 extends downwardly from opening 22 and has a barbed lower end 26. The lower end of tube 24 has oppositely disposed and radially spaced-apart openings 28 and 30 formed therein. A ring-shaped wall 32 extends upwardly from the outer end of wall 18 to form a cavity 70. The ring-shaped wall 32 has an upper end 34 and a cylindrical recessed lower end 36.

The numeral 38 refers to a ring-shaped valve member having a vertically disposed wall member 40 having a lower end 42 and an upper end 44. A horizontally disposed wall 46 extends between wall 40 above the lower end thereof. Valve member 38 has a central opening 48 formed therein and an opening 50 formed therein inwardly of wall member 40. Valve member 38 includes a centrally positioned tube 52 which extends upwardly from wall 46 and has an upper end 54. As seen, central opening 48 is positioned within tube 52.

It should be noted that valve member 38 is selectively rotatably mounted in member 16. FIGS. 1-6 illustrate a single draw container insert having two metered flow outputs which is dependent on the diameters of openings 48 and 50 in valve member 38. When the insert is assembled, as in FIG. 6, liquid may flow from the container by way of cut-outs 28 and 30, up through hollow tube 24 into receptacle 47, and further through openings 48 and 50 in a dual metered manner. The liquid flowing upwardly through opening 50 passes into the area between elements 44 and 54. The liquid flowing upwardly through opening 48 passes into the centrally positioned tube 52. Thus, two independent and metered flow rates are provided. The metering may be changed by changing the element 38 having different opening diameters.

There may be situations wherein openings 48 and 50 are controlled by the apparatus which is in communication with openings 48 and 50.

Figure 7:
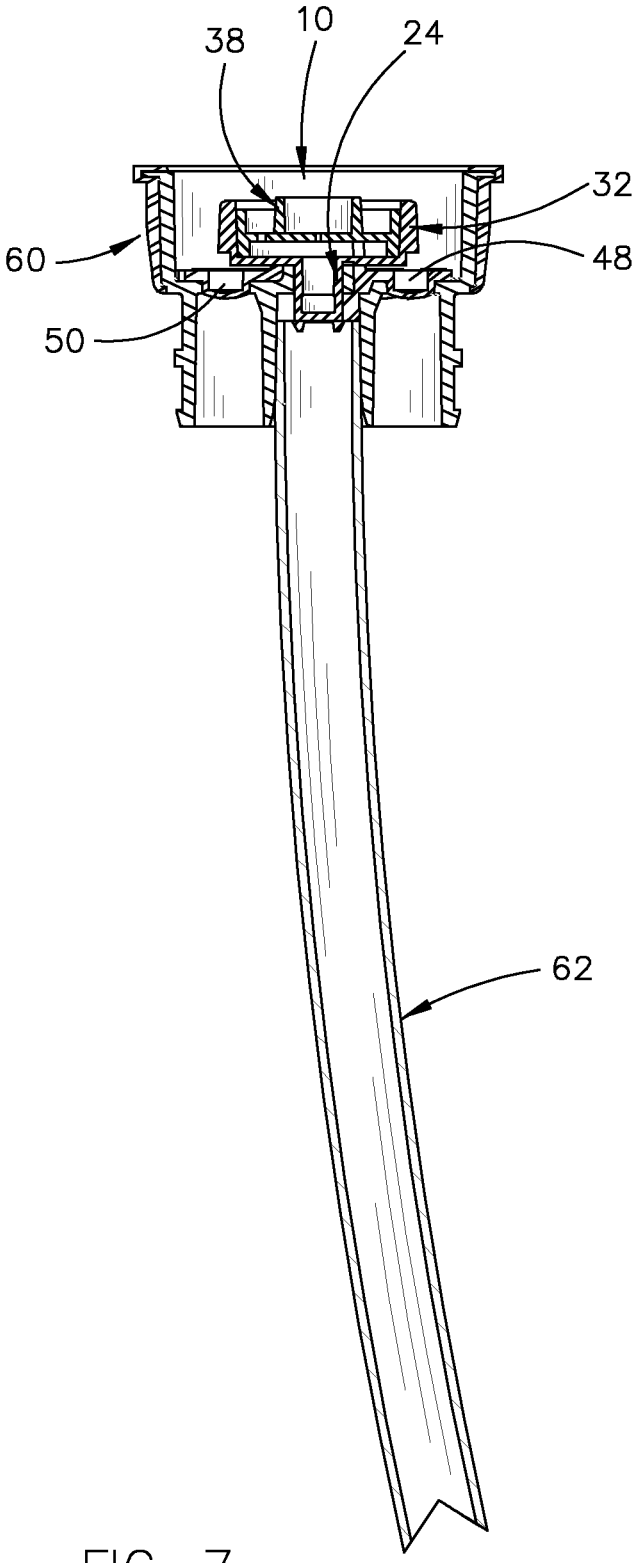
FIG. 7 is a sectional view of a single draw insert having two metered flow outlets.

FIG. 7 illustrates a single draw container insert 10 of this invention. In FIG. 7, the numeral 60 designates an insert having a single draw 62 extending therefrom which will be inserted into a container having liquid therein.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A valve for a single draw container insert having two metered flow outlets, comprising:

a lower support member comprising:

a) a horizontally disposed first bottom wall having an outer end, an inner end, an upper side and a lower side;

b) a central opening formed at the inner end of said first bottom wall;

c) a hollow cylindrical tube having an upper end and a lower end;

d) said upper end of said hollow cylindrical tube being in communication with said central opening in said first bottom wall whereby said hollow cylindrical tube extends downwardly from said first bottom wall;

e) said lower end of said first tube comprising at least two barbs diametrically opposed on each side of the hollow cylindrical tube;

f) a vertically disposed first ring-shaped wall extending upwardly from the outer end of said first bottom wall to form a cavity;

g) the first ring-shaped wall having an upper end and a lower end;

h) the lower end of the first ring-shaped wall comprising a cylindrical recess on an exterior side of the first ring-shaped wall and adjacent the first bottom wall;

a valve member configured to be mounted inside said cavity of said lower support member;

said valve member comprising:

a) a horizontally disposed second bottom wall having a first end, a second end, an upper surface and a lower surface;

b) a vertically disposed second ring-shaped wall having an upper end, a lower end, an inside surface, and an outer surface;

c) said second bottom wall being secured to the inside surface of said second ring-shaped wall at a position between the upper end and the lower end of said second ring-shaped wall;

d) a centrally positioned tube having an interior surface and an exterior surface wherein the centrally positioned tube extends upwardly from said second bottom wall;

e) said second bottom wall having a first liquid flow metering opening formed therein at a position inside the centrally positioned tube;

f) said second bottom wall having a second liquid flow metering opening formed therein at a position interior to the ring-shaped wall and exterior from the centrally positioned tube;

g) said first liquid flow metering opening and said tube creating a first flow outlet; and h) said second liquid flow metering opening, the inside surface of said second ring-shaped wall, and the exterior surface of said centrally positioned tube creating a second flow outlet;

wherein the upper end of the first ring-shaped wall extends above the upper end of the second ring-shaped wall when the valve member is mounted inside the cavity of said lower support member.

2. The valve of claim 1 wherein diameters of said first and second liquid flow metering openings comprise different sizes to change the first and second flow outlets.

3. The valve of claim 1 wherein said second liquid flow metering opening may be controlled by a single draw container insert.

4. The valve of claim 1 wherein said valve member is rotatably mounted inside the cavity of said lower support member.

5. The valve of claim 1 wherein said lower end of said hollow cylindrical tube has first and second radially spaced-apart cut-out openings formed therein.

6. A single draw container insert, comprising:

a lower support member, comprising:

a) a horizontally disposed first bottom wall having a central opening;

b) a vertically disposed first ring-shaped wall having an upper end and a lower end;

c) the first ring-shaped wall extending upward from an outer end of said first bottom wall to form a cavity;

d) the lower end of the first ring-shaped wall comprising a cylindrical recess on an exterior side of the first ring-shaped wall and adjacent to the first bottom wall;

e) a first tube having an upper end and a lower end;

f) the upper end of said first tube being in communication with the central opening of said first bottom wall; and g) the first tube extending downward from said first bottom wall;

a valve member, comprising:

a) a horizontally disposed second bottom wall having a first liquid flow metering opening and a second liquid flow metering opening;

b) the first liquid flow metering opening and the second liquid flow metering opening configured to control volume flow rate of a liquid;

c) a vertically disposed second ring-shaped wall having an upper end and a lower end;

d) the second ring-shaped wall positioned exterior to said second bottom wall;

e) the second bottom wall positioned between the upper end and the lower end of said second ring-shaped wall;

f) a second tube extending upward from said second bottom wall;

g) the first liquid flow metering opening positioned inside the second tube; and h) the second liquid flow metering opening positioned interior to the ring-shaped wall and exterior from the second tube;

wherein the valve member is configured to be mounted inside the cavity of said lower support member.

7. The single draw container insert of claim 6, wherein the upper end of said first ring-shaped wall extends above the upper end of said second ring-shaped wall when the valve member is mounted inside the cavity of said lower support member.

8. The single draw container insert of claim 6, wherein the valve member is rotatably mounted inside the cavity of said lower support member.

9. The single draw container insert of claim 6, wherein the lower end of said first tube has first and second radially spaced-apart cut-out openings formed therein.

10. The single draw container insert of claim 6, wherein the lower end of said first tube comprises at least two barbs diametrically opposed on each side of said first tube.

11. The single draw container insert of claim 6, wherein said first bottom wall comprises a disc-shape.

12. The single draw container insert of claim 6, wherein the first tube and the second tube are hollow cylindrical tubes.

13. The single draw container insert of claim 6, wherein said second liquid flow metering opening may be controlled by a single draw container insert.

14. The single draw container insert of claim 6, further comprising:

a first flow outlet formed from the first liquid flow metering opening and the second tube; and a second flow outlet formed from the second liquid flow metering opening, an inside surface of said second ring-shaped wall, and an exterior surface of said second tube.

15. The single draw container insert of claim 14, wherein a diameter of said first liquid flow metering opening is a different size from a diameter of said second liquid flow metering opening to provide distinct volume flow rates of the liquid through the first and second flow outlets.

16. A single draw container insert, comprising:

a lower support member, comprising:

a) a first bottom wall having a central opening;

b) a first ring-shaped wall;

c) the first ring-shaped wall extending upward from an outer end of said first bottom wall to form a cavity;

d) a first tube; and e) an upper end of said first tube being in communication with the central opening of said first bottom wall;

a valve member, comprising:

a) a second bottom wall having at least two liquid flow metering openings;

b) the at least two liquid flow metering openings configured to control volume flow rate of a liquid;

c) a second ring-shaped wall;

d) the second ring-shaped wall positioned exterior to said second bottom wall;

e) the second bottom wall positioned between an upper end and a lower end of said second ring-shaped wall;

f) a second tube;

g) a first liquid flow metering opening positioned inside the second tube; and h) a second liquid flow metering opening positioned interior to the ring-shaped wall and exterior from the second tube;

wherein the valve member is configured to be mounted inside the cavity of said lower support member.

17. The single draw container insert of claim 16, wherein an upper end of said first ring-shaped wall extends above an upper end of said second ring-shaped wall when the valve member is mounted inside the cavity of said lower support member.

18. The single draw container insert of claim 16, said first tube comprising:

first and second radially spaced-apart cut-out openings; and at least two barbs diametrically opposed on each side of said first tube;

wherein the at least two barbs create space for liquid to flow through the first and second radially spaced-apart cut-out openings when the first tube is attached to a single draw.

19. The single draw container insert of claim 16, further comprising:

a first flow outlet formed from the first liquid flow metering opening and the second tube; and a second flow outlet formed from the second liquid flow metering opening, an inside surface of said second ring-shaped wall, and an exterior surface of said second tube.

20. The single draw container insert of claim 19, wherein a diameter of said first liquid flow metering opening is a different size from a diameter of said second liquid flow metering opening to provide distinct volume flow rates of the liquid through the first and second flow outlets.

* * * * *